US006102225A

United States Patent [19]

Lynn

[11] Patent Number: 6,102,225

[45] Date of Patent: Aug. 15, 2000

[54] CONTAINER WITH INTERNALLY THREADED FINISH AND SEAL

[75] Inventor: Stephen R. Lynn, Douglasville, Ga.

[73] Assignee: Ball Corporation, Broomfield, Colo.

[21] Appl. No.: 09/036,246

[22] Filed: Mar. 6, 1998

[51] Int. Cl.[7] ..... B65D 39/08; B65D 41/34; B65D 41/58

[52] U.S. Cl. ..... 215/252; 215/256; 215/344; 215/354; 215/356; 215/901

[58] Field of Search ..... 215/252, 250, 215/253, 254, 256, 307, 318, 320, 329, 341, 343, 344, 354, 356, 357, 40, 44, 211, 223, 901; 220/366.1

[56] References Cited

U.S. PATENT DOCUMENTS

| | | | |
|---|---|---|---|
| 1,457,418 | 6/1923 | Baldwin | 215/357 |
| 2,993,612 | 7/1961 | Trautvetter . | |
| 3,001,658 | 9/1961 | Herter . | |
| 3,391,838 | 7/1968 | Gundel . | |
| 3,428,208 | 2/1969 | Kosar . | |
| 3,613,938 | 10/1971 | Westcott | 220/366.1 |
| 3,910,444 | 10/1975 | Foster | 215/320 |
| 3,991,895 | 11/1976 | Thornton | 215/320 |
| 4,342,400 | 8/1982 | Llera . | |
| 4,708,255 | 11/1987 | Thompson . | |
| 4,711,365 | 12/1987 | Fomby | 215/329 |
| 4,785,963 | 11/1988 | Magley | 215/252 |
| 4,852,751 | 8/1989 | Halfacre . | |
| 4,872,304 | 10/1989 | Thompson . | |
| 4,921,737 | 5/1990 | Akao . | |
| 5,207,341 | 5/1993 | Yeager | 215/329 |
| 5,597,082 | 1/1997 | Luch et al. | 215/44 |

*Primary Examiner*—Allan N. Shoap
*Assistant Examiner*—Niki M. Eloshway
*Attorney, Agent, or Firm*—Locke Reynolds LLP

[57] ABSTRACT

A tamper-indicating container-closure package assembly is composed of a container including a base, a sidewall portion extending upward from the base, and a finish portion connected to an upper region of the sidewall portion defining a mouth of the container. The finish portion includes a threaded portion located inside the mouth which can include at least one interruption for allowing venting of the container as a closure is removed. A seal seat is recessed inside the mouth, yet is situated above the threaded portion, while a radially outwardly bulbous portion protrudes outside of the mouth. The closure includes a threaded cylindrical surface dimensioned to cooperatively engage the threaded portion of the container finish, a top portion radially outwardly extending from the threaded cylindrical surface including a seal portion which depends downwardly from the closure top portion for engagement with the seal seat, and a tamper-evident ring portion depending downwardly from an outer periphery of the top portion of to engage the radially outwardly protruding bulbous portion outside the container mouth. A container support ring is situated below and extending radially outward at least to a point coextensive with a radially outermost surface of the tamper-evident ring portion of the closure. The seal seat can include an annular groove with a plurality of venting grooves extending radially on either side of the seal seat.

8 Claims, 6 Drawing Sheets

CONTAINER WITH INTERNALLY THREADED FINISH AND SEAL

BACKGROUND OF THE INVENTION

1. Field of the Invention

The present invention pertains generally to containers for liquids such as beverages, including carbonated beverages, and cooperating closures for such containers, where the finish of the container includes an internal thread to be cooperatively engaged by the closure.

2. Description of the Prior Art

Conventional containers for liquids such as beverages commonly employ threaded closures. The containers generally have a finish portion surrounding the mouth of the container that includes an external thread for engagement by a closure. The closure is generally of a form that includes a top wall for bridging the mouth of the container and a peripheral skirt including an internal thread engaging the external thread of the container. The external thread of the container may be periodically interrupted to permit safe venting of gases from within the container when the closure is removed therefrom. An engagement ring is typically located a short distance below the external thread of the container for engagement with a tamper-evident band situated at the bottom margin of the skirt of the closure. Upon removal of the closure from the container, the tamper-evident band is intended to be disrupted in one manner or another to present easily recognized visible evidence of prior opening of the container closure. Finally, there is generally situated below the engagement band a support ring that is employed by various container handling equipment during the manufacture and filling of the container.

It will be appreciated that the vertical extent and spacing between the external thread, engagement band, and support ring are subject to some minor variation in design. However, the serial location of these three elements requires some minimum vertical dimension that may be undesirable in certain low aspect ratio containers. It is therefore an object of the present invention to provide a container finish and cooperating closure having all three functional elements found in such conventional containers but arranged in a different combination to present a lower and more compact arrangement of elements.

SUMMARY OF THE INVENTION

In accordance with the present invention, tamper-indicating container-closure package assembly includes a container having a base, a sidewall portion extending upward from the base, and a finish portion connected to the upper region of the sidewall portion defining a mouth for the container. The finish portion includes a threaded portion located inside the mouth, a seal seat adjacent the threaded portion, and a radially outwardly protruding bulbous portion located outside of the mouth. A support ring is located a short distance below the outwardly protruding bulbous portion. The vertical extent of the bulbous portion and the support ring is preferably about the same as the vertical extent of the threaded portion located inside the mouth of the container.

A cooperating closure includes a cylindrical skirt having a threaded cylindrical surface dimensioned to cooperatively engage the threaded portion of the container finish. A top portion bridges the mouth of the container and extends radially outwardly from the threaded cylindrical surface. The radially outwardly extending portion includes a seal portion for engagement with the seal seat, and a tamper-evident ring portion depending generally downwardly from an outer periphery of the top portion to engage the radially outwardly protruding bulbous portion outside the container mouth.

The seal seat is defined by a curved annular ledge located within the mouth, above the threaded portion and adjacent to the bulbous portion. A series of notches or grooves are spaced in a radial array outside the seal seat to facilitate controlled venting of gasses within the container upon release of the closure from the container. The seal portion of the closure includes a generally downwardly protruding ring depending from the top portion of the closure, the ring having a contact surface sufficiently flexible to conform at least in part to the conformation of the seal seat.

One feature of the present invention is the back-to-back arrangement of the three functional elements permitting use of a threaded tamper evident closure on the container mouth. This feature has the advantage of allowing a vertically more compact arrangement of the functional elements. This feature also reduces the amount of resin required to form the container, resulting in lower container costs.

A feature of the present invention is the threaded cylindrical surface of the closure which is formed on the cylindrical skirt of comparable vertical size as a conventional closure but of smaller circumferential size since the skirt is situated inside the container mouth rather than outside of the mouth. This feature also contributes to a reduction in the amount of resin employed to form the closure and contributes to lower closure costs.

Additional features and advantages will be apparent to those skilled in the art upon consideration of the following description of preferred embodiments setting forth the best mode of the invention as presently perceived. The description refers to the accompanying drawings.

DESCRIPTION OF THE PREFERRED EMBODIMENTS

Figure 1:
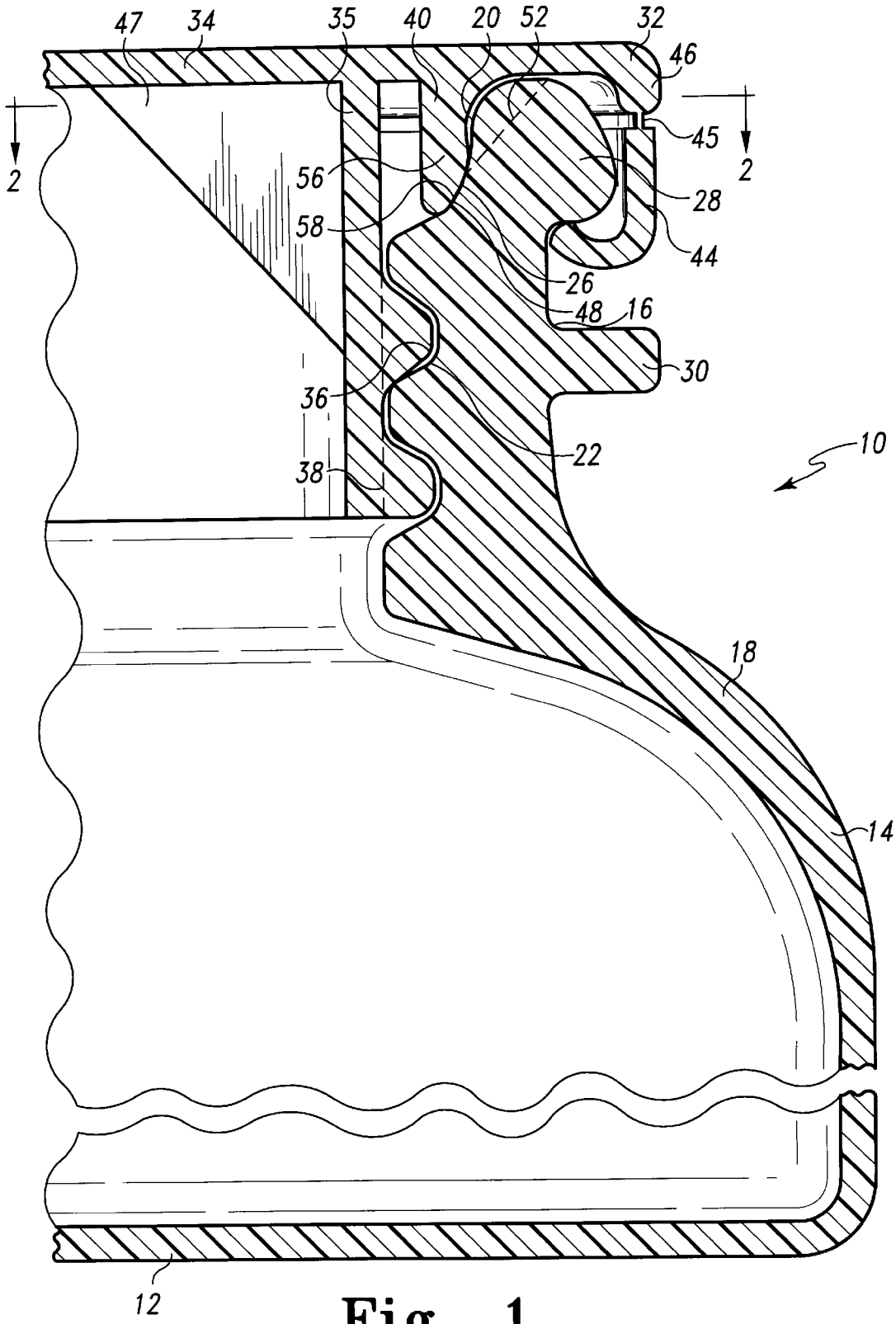
FIG. 1 is an elevational fragmentary section view of a container-closure package assembly representing the present invention.

The following portion of the specification, taken in conjunction with the drawings, sets forth the preferred embodiments of the present invention. The embodiments of the invention disclosed herein are the best mode contemplated for carrying out this invention in a commercial environment, although it should be recognized and understood that various modifications can be accomplished within the parameters of the present invention.

Referring now to the drawings for a detailed description of the present invention, reference is first made to FIGS.

1–2, generally depicting container 10 having base 12, sidewall portion 14 extending upward from base 12, and finish portion 16 connected to upper region 18 of sidewall portion 14. Finish portion 16 defines mouth 20 of container 10, and includes threaded portion 22 located inside mouth 20 and seal seat 26 located adjacent to threaded portion 22, recessed inside mouth 20 and situated above threaded portion 22. Finish portion 16 also includes radially outwardly protruding bulbous portion 28 located outside of mouth 20. Container support ring 30 is situated below and extending radially outward beyond bulbous portion 28. The vertical extent of bulbous portion 28 and support ring 30 is preferably about the same as the vertical extent of threaded portion 22 located inside mouth 20.

Figure 2:
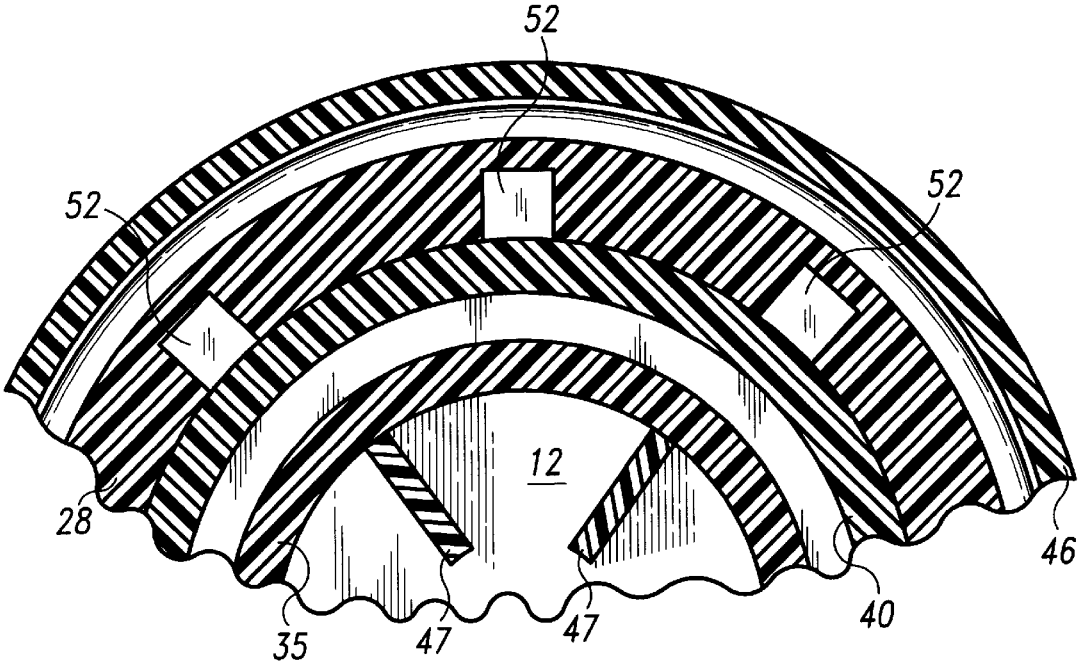
FIG. 2 is a section view taken along line 2—2 of FIG. 1.

With reference to FIGS. 1–2, cooperating closure 32 for hermetically closing mouth 20 of container 10 includes top portion 34 which bridges mouth 20, and generally cylindrical skirt 35, projecting generally downward from top portion 34. Skirt 35 defines outwardly facing threaded cylindrical surface 36 dimensioned to cooperatively engage threaded portion 22 of finish portion 16. Threaded cylindrical surface 36 defines a series of thread interruptions 38, shown in phantom in FIG. 1, for controlled venting of gasses, as will be described. Top portion 34 extends radially outwardly from threaded cylindrical surface 36 and includes generally cylindrical seal portion 40 for sealing engagement with seal seat 26. Seal portion 40 is situated above threaded cylindrical surface 36 and depends generally downwardly from top portion 34. Tamper-evident ring portion 44 depends generally downwardly from outer periphery 46 of top portion 34 to engage bulbous portion 28 of container 10, and includes breakable ribs 45. In addition, where desired to enhance structural integrity, a plurality of support members 47 may be attached between top portion 38 and cylindrical skirt 35.

Seal seat 26 is defined by curved annular ledge 48 located within mouth 20, above threaded portion 22 and adjacent to bulbous portion 28 for sealing engagement by seal portion 40 of closure 32. A series of venting notches or grooves 52 are defined in finish portion 16 and are spaced in a radial array outside seal seat 26 to facilitate controlled venting of gasses within container 10 upon release of closure 32 from container 10. Seal portion 40 of closure 32 includes generally downwardly protruding ring 56 depending from top portion 34. Ring 56 has contact surface 58 formed of a flexible material, such as plastic, that is sufficiently flexible to permit ring 56 to conform at least in part to seal seat 26 of finish portion 16.

Figure 3:
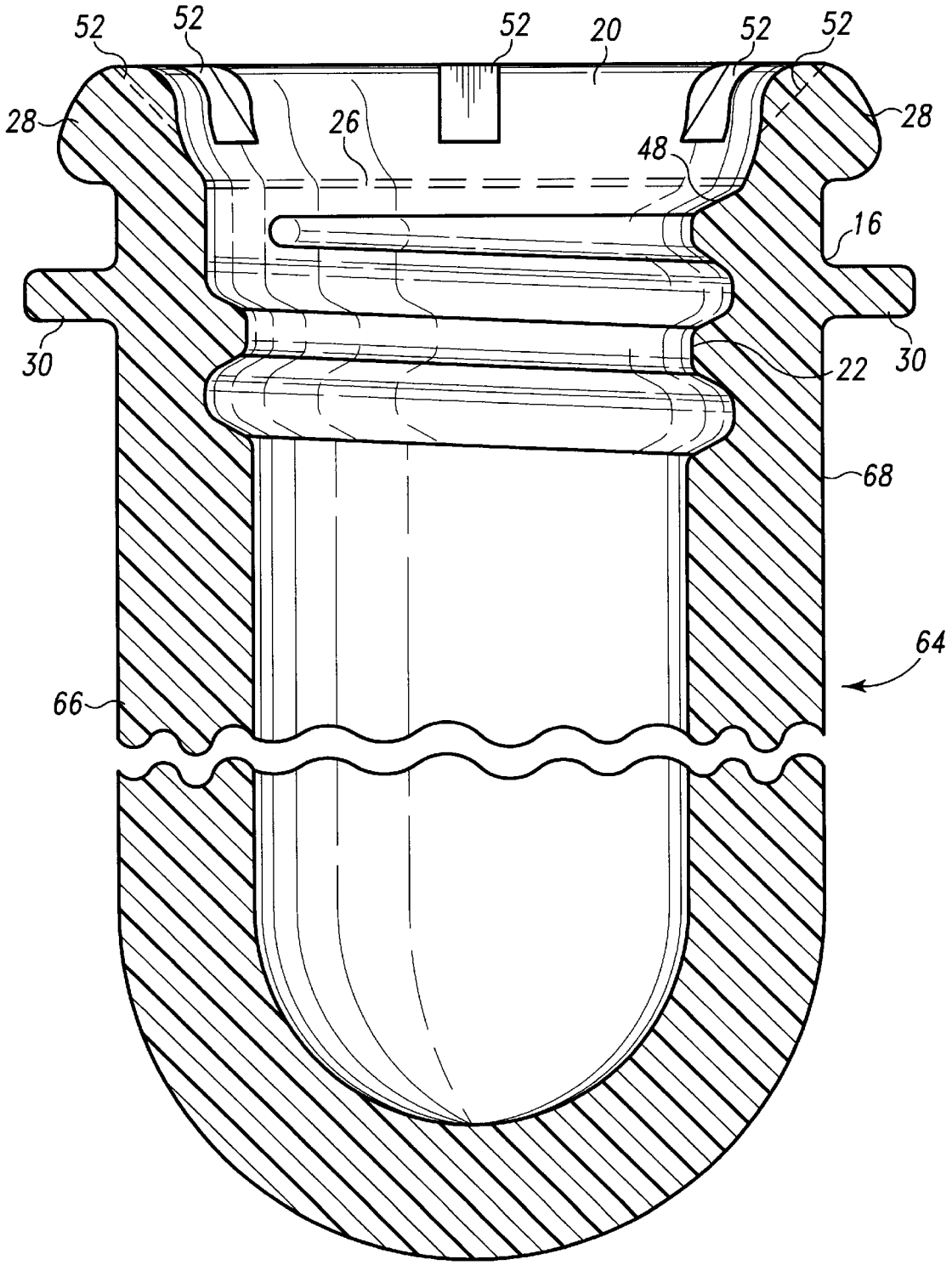
FIG. 3 is an elevational section view of a parison representing the present invention.

Referring now to FIG. 3, parison 64 for forming container 10 within a blow mold, not shown, having an interior surface for defining an exterior surface of container 10, includes body portion 66 for transformation within the blow mold into container base 12 and sidewall portion 14, and finish portion 16 connected to upper section 68 of body portion 66 for remaining untransformed during the transformation of body portion 66 into container 10 during blow molding.

In use, contact surface 58 of ring 56 flexibly bears against seal seat 26 of finish portion 16, thereby disposing closure 32 in sealed contact with container 10, and with tamper evident ring portion 44 of closure 32 secured around bulbous portion 28 of container 10. For removal of closure 32, closure 32 is rotated with respect to container 10, causing the sealed contact between contact surface 58 and seal seat 26 to be breached. After breach of the sealed contact, any gas pressure which has built up within container 10 is safely vented through thread interruptions 38 of closure 32, past seal seat 26, and through notches or grooves 52 of finish portion 16. Upon continued rotation of closure 32, frangible tearing and breaking of ribs 45 of ring portion 44 occurs, permitting removal of closure 32.

One feature of the present invention is the back-to-back arrangement of three functional elements of container 10, that is threaded portion 22, seal seat 26, and bulbous portion 28. This feature has the advantage of allowing a vertically more compact arrangement of such functional elements as compared to conventional containers, while permitting use of tamper evident closure 32 on mouth 20. This feature also reduces the amount of resin needed to form container 10, thereby contributing to lower container costs.

Another feature of the present invention is that threaded cylindrical surface 36 of closure 32 is formed on skirt 35 that is of comparable vertical size to a conventional closure, but has smaller circumferential size since skirt 35 is situated inside mouth 20, rather than outside as with conventional containers and closures. This feature also contributes to a reduction in the amount of resin employed to form closure 32, lowering costs to produce the closures.

Figure 4:
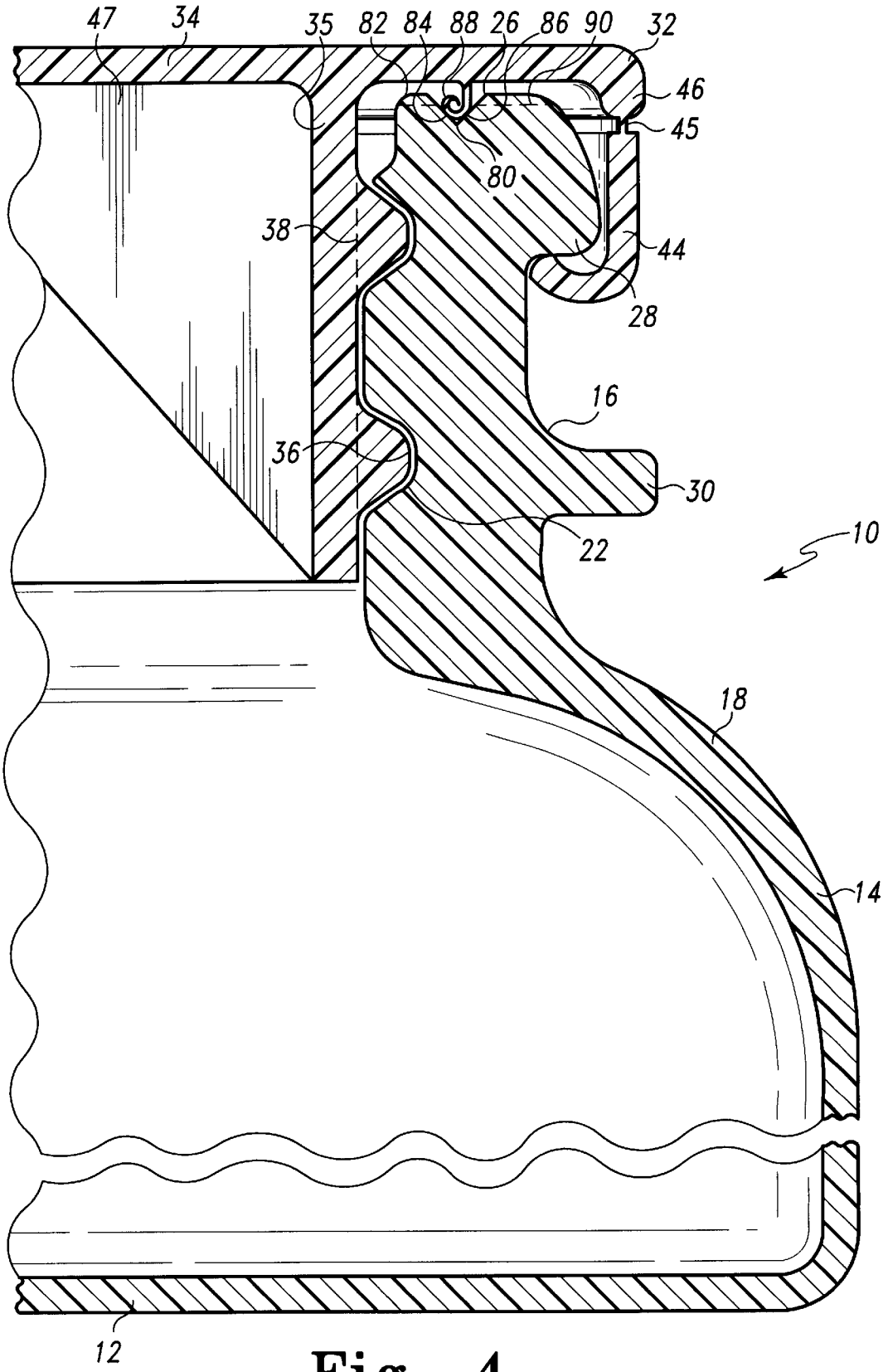
FIG. 4 is an elevational fragmentary section view of a container-closure package assembly representing a second embodiment of the present invention.
Figure 5:
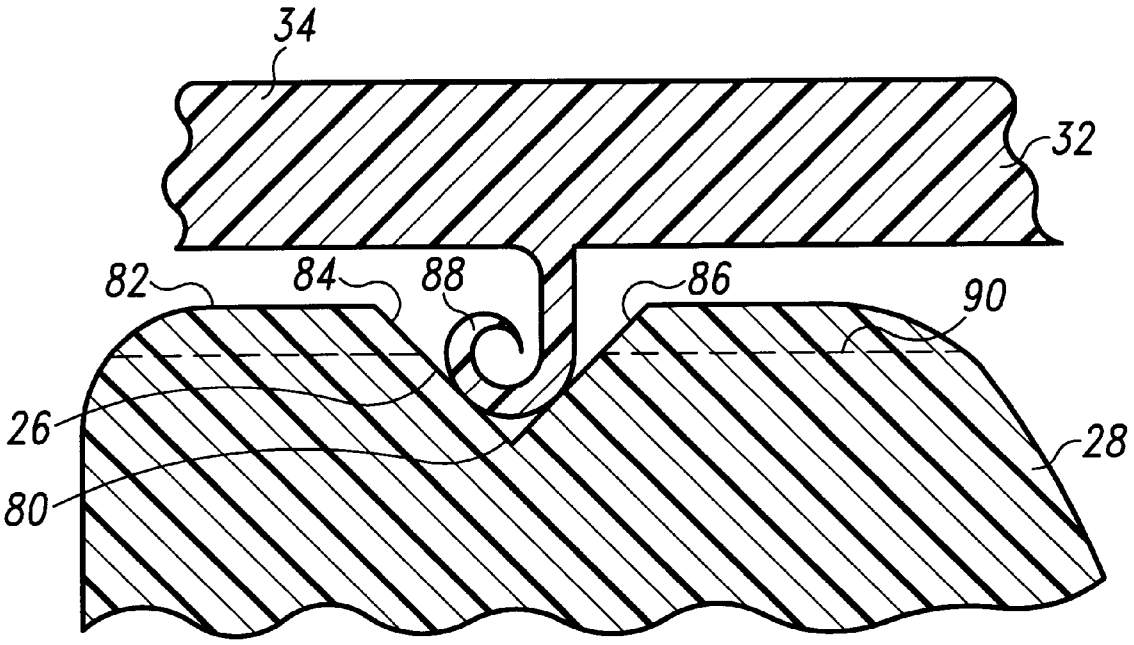
FIG. 5 is an enlarged detail partial section view of the seal element, annular groove and venting slit of a container-closure package assembly representing a second embodiment of the present invention.

Referring now to FIGS. 4–5, in a second embodiment of the present invention, seal seat 26 is defined by generally annular groove 80 located at top margin 82 of bulbous portion 28. As illustrated, annular groove 80 is generally V-shaped in cross-section, defining angled inner surface 84 and outer surface 86. Cooperating closure 32 includes top portion 34 which has generally circular, curled seal element 88. Curled seal element 88 depends generally downwardly from top portion 34, and is positioned for sealing engagement partially within annular groove 80. Seal element 88 is preferably formed of a flexible material, such as plastic, that is sufficiently flexible to permit seal element 88 to conform to and between inner and outer surfaces 84 and 86. A series of generally horizontal venting slits 90, shown in phantom, are defined in top margin 82 of bulbous portion 28 and spaced in a radial array through seal element 88 to facilitate controlled venting of gasses within container 10 upon release of closure 32 from container 10.

Figure 6:
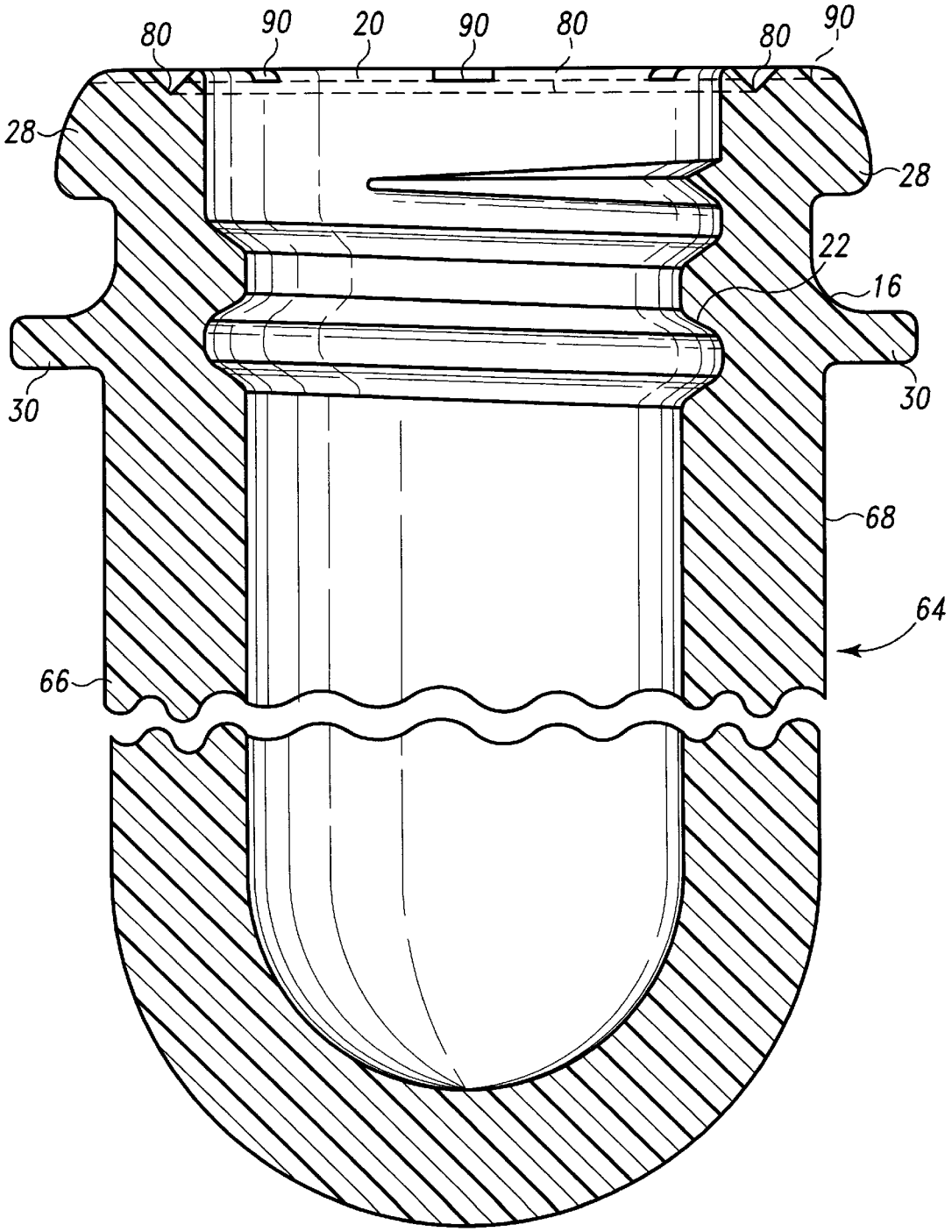
FIG. 6 is an elevational section view of a parison representing a second embodiment of the present invention.

With reference to FIG. 6 in the second embodiment of the present invention, parison 64 for forming container 10 within the blow mold includes finish portion 16 connected to upper section 68 of body portion 66 and has annular groove 80 and generally horizontal venting slits 90 defined in top margin 82 of bulbous portion 28. During the transformation of body portion 66 into container 10 during blow molding, finish portion 16, annular groove 80 and venting slits 90 remain untransformed.

The present invention having been described in its preferred embodiments, it is clear that the present invention is susceptible to numerous modifications and embodiments within the ability of those skilled in the art and without the exercise of the inventive faculty. Accordingly, the scope of the present invention is defined as set forth by the scope of the following claims.

What is claimed is:

1. A tamper-indicating container-closure package assembly comprising:

a container including a base, a sidewall portion extending upward from the base, and a finish portion connected to an upper region of the sidewall portion defining a mouth of the container, the finish portion including a threaded portion located inside the mouth, a seal seat adjacent the threaded portion, a radially outwardly protruding bulbous portion located outside of the mouth, and a support ring situated below the bulbous portion, a closure including a threaded cylindrical surface dimensioned to cooperatively engage the threaded portion of the finish portion, a top portion radially outwardly extending from the threaded cylindrical surface including a seal portion for sealing engagement with the seal seat, and a tamper-evident ring portion depending generally downwardly from an outer periphery of the top portion to engage the radially outwardly protruding bulbous portion outside of the mouth, the support ring extending radially outward at least to a point coextensive with a radially outermost surface of the tamper-evident ring portion of the closure.

2. The container-closure package assembly of claim 1 wherein said threaded portion defines at least one interruption for allowing venting of the container as the closure is removed from the container.

3. The container-closure package assembly of claim 1 wherein said seal seat is recessed inside the mouth, yet is situated above the threaded portion, and said seal portion depends generally downwardly from the top portion of the closure.

4. The container-closure package assembly of claim 3 wherein the finish portion defines a plurality of venting grooves extending radially from the seal seat.

5. The container-closure package assembly of claim 3 wherein said seal seat defines an annular groove for removably receiving said seal portion.

6. The container/closure assembly of claim 1 wherein the bulbous portion of the container is disposed within the vertical extent occupied by the threaded portion of the finish portion.

7. The container/closure assembly of claim 1 wherein the support ring portion of the container is disposed within the vertical extent occupied by the threaded portion of the finish portion.

8. The container/closure assembly of claim 1 wherein the bulbous portion of the container and the support ring are disposed within the vertical extent occupied by the threaded portion of the finish portion.

* * * * *